US011486096B2

(12) United States Patent
Fan et al.

(10) Patent No.: US 11,486,096 B2
(45) Date of Patent: Nov. 1, 2022

(54) METHOD FOR STRENGTHENING AND REINFORCING ANCIENT BOOKS

(71) Applicant: SOUTH CHINA UNIVERSITY OF TECHNOLOGY, Guangdong (CN)

(72) Inventors: Huiming Fan, Guangdong (CN); Jianhua Chen, Guangdong (CN); Haibin Wang, Guangdong (CN); Qian Gan, Guangdong (CN); Jiahe Li, Guangdong (CN); Da Gao, Guangdong (CN); Mingfeng Guo, Guangdong (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 464 days.

(21) Appl. No.: 16/632,544

(22) PCT Filed: Oct. 31, 2018

(86) PCT No.: PCT/CN2018/113228
§ 371 (c)(1),
(2) Date: Jan. 21, 2020

(87) PCT Pub. No.: WO2019/105167
PCT Pub. Date: Jun. 6, 2019

(65) Prior Publication Data

US 2020/0157743 A1 May 21, 2020

(30) Foreign Application Priority Data

Nov. 28, 2017 (CN) ..... 201711217601.8

(51) Int. Cl.
*D21H 21/18* (2006.01)
*D21H 25/18* (2006.01)
(Continued)

(52) U.S. Cl.
CPC ..... *D21H 25/18* (2013.01); *B42C 19/00* (2013.01); *D21H 25/04* (2013.01)

(58) Field of Classification Search
None
See application file for complete search history.

(56) References Cited

U.S. PATENT DOCUMENTS 5,482,781 A * 1/1996 Wittekind ..... D21H 25/18 427/140
6,471,915 B1 * 10/2002 Bell ..... B41M 7/0063 118/313
(Continued)

FOREIGN PATENT DOCUMENTS

CN 203729150 7/2014
CN 107012736 8/2017
(Continued)

OTHER PUBLICATIONS

Machine translation of CN103898801A; https://worldwide.espacenet.com/ (Year: 2014).*
(Continued)

*Primary Examiner* — Leslie A Nicholson, III
(74) *Attorney, Agent, or Firm* — JCIPRNET

(57) ABSTRACT

A novel method for strengthening and reinforcing ancient books is provided. Such treatment method comprises: first placing the ancient books to be treated in a closed strengthening and reinforcing device; after sealing, performing dehumidification operation and vacuumizing operation on system in sequence to maintain the system dry; and after the system is stable under negative pressure, turning on a fan set, directly delivering a strengthening and reinforcing powder to the strengthening and reinforcing device via a gas pipe, or atomizing a strengthening and reinforcing solution through a ultrasonic atomizer and then delivering the atomized solution to the strengthening and reinforcing device via the
(Continued)

gas pipe, so that the ancient books to be treated absorb the strengthening and reinforcing agent sufficiently and evenly; and meanwhile monitoring pH value and humidity of the ancient books, thereby implementing strengthening and reinforcement of the ancient books.

10 Claims, 2 Drawing Sheets

(51) Int. Cl.
*D21H 25/04* (2006.01)
*B42C 19/00* (2006.01)

(56) References Cited

U.S. PATENT DOCUMENTS 6,645,298 B1 * 11/2003 Herren ..... C01D 7/00 118/313
8,540,848 B2 * 9/2013 Blankenborg ..... D21H 25/18 162/265

FOREIGN PATENT DOCUMENTS

| | | | | |
|---|---|---|---|---|
| CN | 107385994 | | 11/2017 | |
| CN | 108004846 | | 5/2018 | |
| CN | 110106743 | A * | 8/2019 | |
| EP | 1069238 | A1 * | 1/2001 | ..... D21H 25/18 |

OTHER PUBLICATIONS

"International Search Report (Form PCT/ISA/210) of PCT/CN2018/113228", dated Jan. 18, 2019, with English translation thereof, pp. 1-4.

* cited by examiner

METHOD FOR STRENGTHENING AND REINFORCING ANCIENT BOOKS

CROSS-REFERENCE TO RELATED APPLICATION

This application is a 371 of international application of PCT application serial no. PCT/CN2018/113228, filed on Oct. 31, 2018, which claims the priority benefit of China application no. 201711217601.8, filed on Nov. 28, 2017. The entirety of each of the above mentioned patent applications is hereby incorporated by reference herein and made a part of this specification.

TECHNICAL FIELD

The present invention relates to the field of the strengthening and reinforcement of ancient books, and particularly relates to a novel method for strengthening and reinforcing ancient books.

BACKGROUND

Thousands of precious books, calligraphy and paintings, modern newspaper, files and other cultural relics are preserved in various libraries, museums and archives in China. Being the essence of the Chinese nation's excellent traditional culture and a significant constituent of the Chinese cultural heritage with important historic value, cultural value and information value, they possess an irreproducible historic significance. As a carrier of the literal essence, paper would suffer a critical situation by the increasing severe worm damage, acidification, mildew and breakage with the time flies. Paper is made from fibrous materials, and the stability of cellulose is one of the most important factors that maintain the physical performances of paper. Cellulose is relatively stable under neutral and alkalescent conditions and generally would not be hydrolyzed or oxidized. However, in an acidic condition, hydrolysis on the cellulose is enhanced due to the catalysis of acid. After the hydrolysis of cellulose, strength of ancient books will be reduced by the decreased degree of polymerization, resulting in pulverization of ancient books over time. Various factors such as acidic chemical residues during production, organic acid generated by aging and degradation, acidification resulted by the use and storage environment, may intensify the aging of paper. The severely reduced paper strength has already affected the normal reading of ancient books. Thus, there's an urgent need of thorough strengthening and reinforcement research on paper documents. Although various researches on strengthening and reinforcing paper documents have been carried out by the domestic and foreign research institutes, practically applicable and mature strengthening and reinforcement technology has not been achieved till now.

The strengthening and reinforcement technology in the prior art is mainly performed by sizing, coating and laminating. However, these processes is carried out merely on a single piece of paper, and when an entire ancient book requires treatment, it is unable to perform sizing, coating and laminating on the paper. First, the process of treatment to paper one piece by one piece is too complicated and overloaded. Secondly, these processes require drying after treating one piece of paper. Otherwise, paper of the ancient book would adhere to each other, resulting in secondary damage. Therefore, the strengthening and reinforcement technology for ancient books in the prior art all have respective defects such as high cost, high difficulty of operation, failure to develop in large-scale, potential safety hazard, environmental pollution, etc. A practically applicable strengthening and reinforcement method for a large-scale of ancient books has not been found till now.

SUMMARY

Aiming at the above and in order to overcome the above-mentioned problems or at least partially overcome the above-mentioned problems, the present invention provides a novel method for strengthening and reinforcing ancient books.

In the present invention, a gas phase strengthening and reinforcement technology and a liquid phase strengthening and reinforcement technology are combined together, and by using a gas phase/liquid phase and a gas phase/solid phase strengthening and reinforcement technologies, not only secondary damage of paper adhesion caused by the liquid phase strengthening and reinforcement is avoided, but also the present technology aims at that original temperature and humidity of the ancient books are kept without drying the ancient books, so that fibers would not age or break, and the ancient books would not be yellowed or damaged. Meanwhile, it also avoids the trouble that a paper strengthening and reinforcing gas suitable for the gas phase strengthening and reinforcement cannot be found. Most of the organic/inorganic strengthening and reinforcing liquid and the nanoscale strengthening and reinforcing powder can be used for strengthening and reinforcing the ancient books by using the present technology.

A novel method for strengthening and reinforcing ancient books, comprises: first placing the ancient books to be treated in a closed strengthening and reinforcing device; after sealing, performing dehumidification operation and vacuumizing operation on the system in sequence to maintain the system dry; and after the system is stable under negative pressure, turning on a fan set, directly delivering a strengthening and reinforcing agent to the strengthening and reinforcing device via a gas pipe, or atomizing a solution of the strengthening and reinforcing agent through a ultrasonic atomizer and then delivering the atomized solution of the strengthening and reinforcing agent to the strengthening and reinforcing device via the gas pipe, so that the ancient books to be treated absorb the strengthening and reinforcing agent sufficiently and evenly; and meanwhile monitoring humidity of the ancient books, thereby implementing strengthening and reinforcement of the ancient books;

wherein the ancient books comprises ancient book, archived file, document, literature, journal, paper, calligraphy and painting, cotton and flax.

In the above-mentioned method, the closed device has good airtightness, and the system is kept at room temperature, so that a relatively high dryness and a relatively high vacuum degree therein can be reached. The closed device has a suitable volume. A relationship of a device volume and a total volume of the ancient books to be treated satisfies that a ratio of the device volume to the total volume of the ancient books to be treated is 1.1:1-50:1.

In the above-mentioned method, the dehumidification operation is as follows: dehumidifying the system to have air humidity of 10%-90% through a dehumidifier and maintaining for 2-24 hours, when target duration is reached, turning off the dehumidifier. Duration of the dehumidification operation depends on an original humidity of the ancient books and the closed device volume; when the original humidity of the ancient books is 8%-9% and the device volume is 1.5-2 times the total volume of the ancient books to be treated, the dehumidification operation lasts for 2-24 hours; when the original humidity is reduced by 10%, the duration of the dehumidification operation is reduced by 2-6 hours; when the device volume is doubled, the duration of the dehumidification operation is increased by 3-8 hours.

In the above-mentioned method, the vacuumizing operation is performed as follows after the dehumidification operation is completed, vacuumizing the system to have an inner pressure of 0 to −0.08 MPa through a vacuum pump, when target pressure is reached, turning off the vacuum pump, and maintaining the closed system under stable negative pressure until the strengthening and reinforcement is completed.

In the above-mentioned method, the ultrasonic atomizer is an ultrasonic transducer, the ultrasonic transducer is placed in a container containing with the strengthening and reinforcing agent and is powered on. The structure of the strengthening and reinforcing agent is dispersed and atomized into small-molecular atomized gas by means of high-frequency resonance of a piezoelectric ceramic.

In the above-mentioned method, the strengthening and reinforcing agent is a nanoscale strengthening and reinforcing powder, an organic solution, or an inorganic solution; the solution of the strengthening and reinforcing agent includes chemicals such as an adhesive, a graft copolymer, a complex strengthening agent, a catalyst and the like. By means of a pressurizing or ultrasonic atomizer, the solution is dispersed into liquid drops in micronscale to nanoscale having an average particle size of 1 nm-2 μm, and is communicated with the closed strengthening and reinforcing device via the gas pipe.

In the above-mentioned method, the strengthening and reinforcing agent includes a nanoscale polyvinyl alcohol powder, a nanoscale carboxymethyl cellulose powder, a nanocellulose powder, and the like.

In the above-mentioned method, through the gas pipe, the fan set slowly introduces the nanoscale strengthening and reinforcing powder or the strengthening and reinforcing agent atomized by the ultrasonic transducer into the closed strengthening and reinforcing device, and circulates the strengthening and reinforcing agent inside the system for even distribution.

In the above-mentioned method, air humidity inside the system is maintained at 10%-90%.

In the above-mentioned method, the strengthening and reinforcing device has an ancient book humidity monitor therein, after the ancient book humidity monitored reaches approximately 3%-10% and is maintained for 1-48 hours, the system is turned off; the duration depends on the humidity of the ancient books and a closed device volume, when the original humidity of the ancient books is 5%-10% and the device volume is 1.5-2 times a total volume of the ancient books to be treated, the strengthening and reinforcement lasts for 2-5 hours; when the original humidity is increased by 1%, the duration of strengthening and reinforcement is reduced by 1-6 hours; when the device volume is doubled, the duration of strengthening and reinforcement is increased by 3-8 hours.

Compared with prior art, the advantages of the present invention lie in that: a large-scale of aged ancient books can be treated, without a great deal of equipment input, or affecting the original temperature and humidity of the ancient books, damage to paper structure, or secondary damage to the ancient books, so that each property of the paper of the ancient book can be well enhanced with significant strengthening and reinforcement effect. Meanwhile, a certain amount of the strengthening agent would left in the ancient books so as to further prolong lifetime of the ancient books better.

Figure 1:
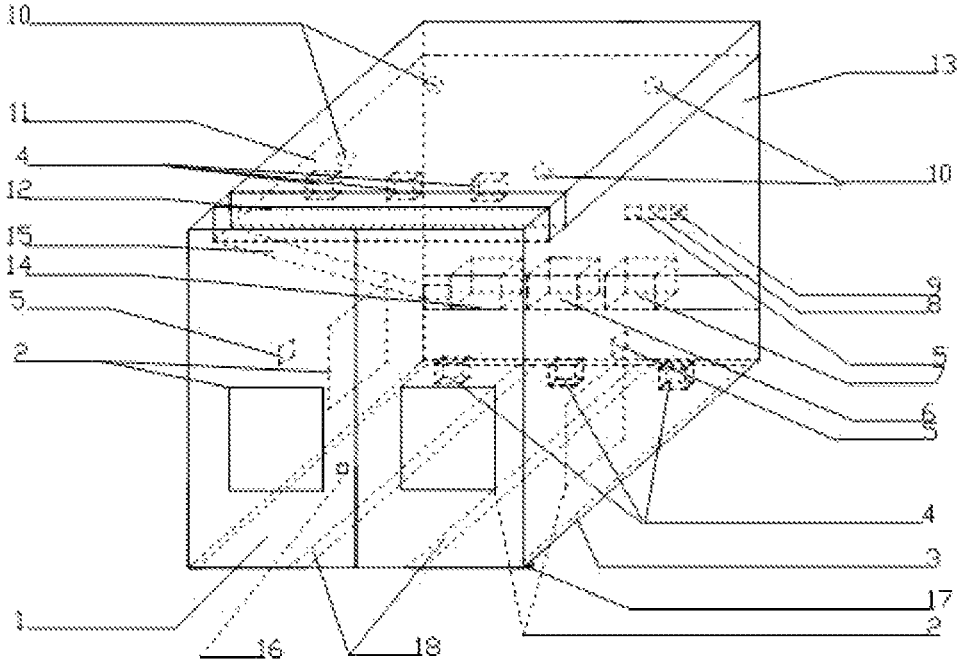
FIG. 1 is a structural diagram of a strengthening and reinforcing device of the present invention.

Each component in the figures is as follows: double-open front door 1, visible window 2, water groove 3, fan set 4, hygrometer 5, dehumidifier 6, vacuum pump 7, piezometer 8, pH meter 9, light 10, middle partition 11, gas pipe hole 12, rear panel 13, ultrasonic atomizer 14, gas pipe 15, PLC-control system 16, drain valve 17, pulley track 18, bookrack 19, and air outlet 20.

DETAILED DESCRIPTION

The present invention is further described in detail by combining the following specific embodiment, but the implementation of the present invention is not limited thereto. Those technological parameters which are not described particularly can be carried out by referring to conventional technologies.

Figure 2:
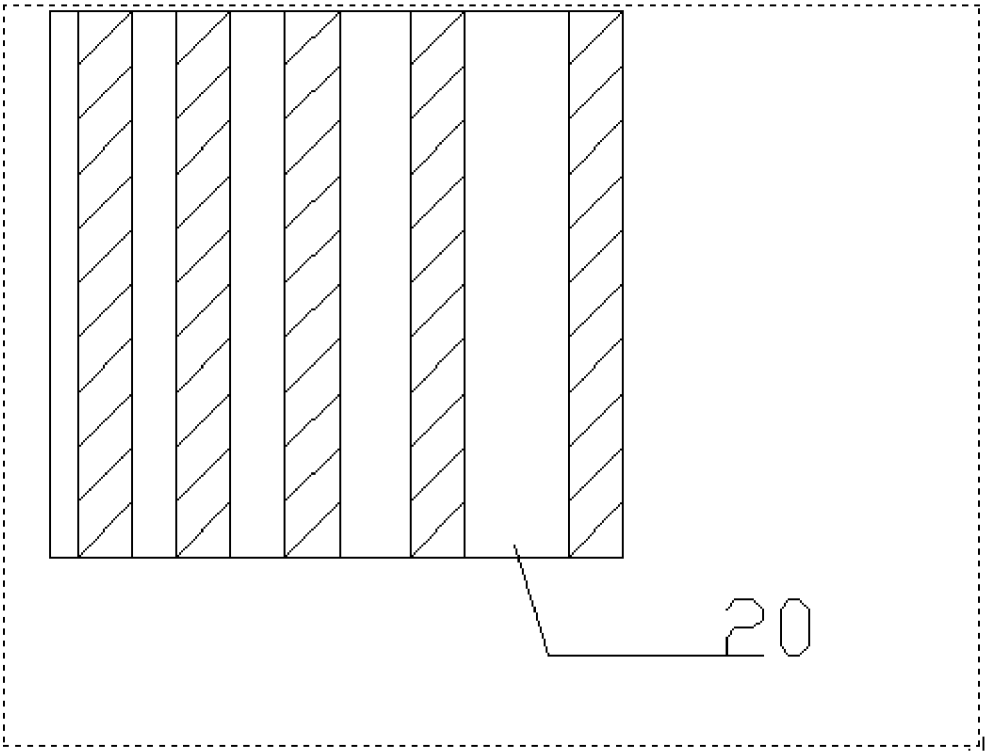
FIG. 2 is a structural diagram of a middle partition.
Figure 3:
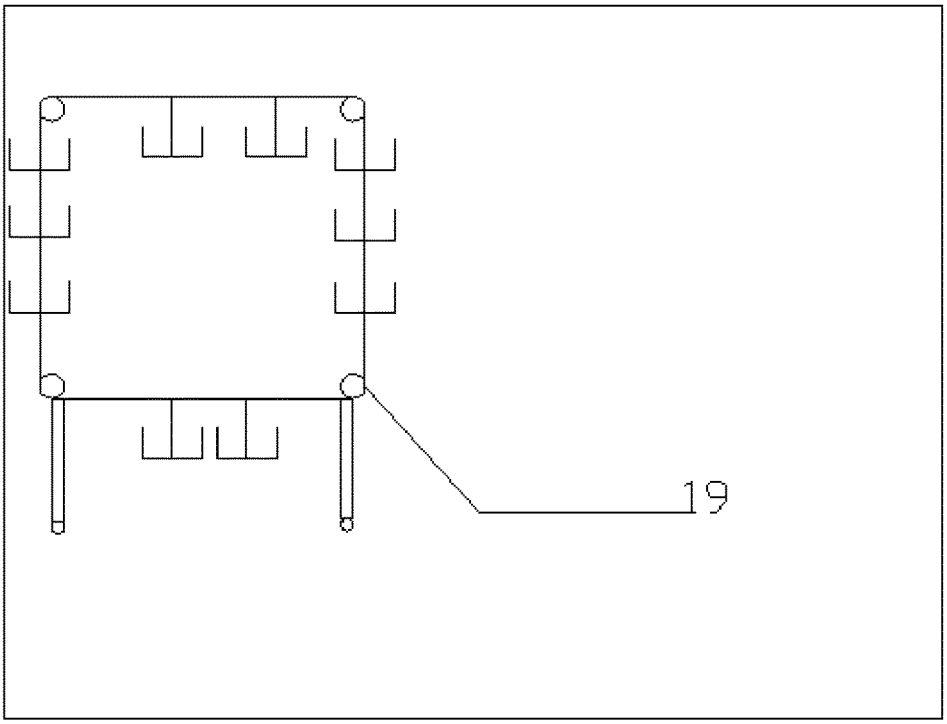
FIG. 3 is a structural diagram of a bookrack.
Figure 4:
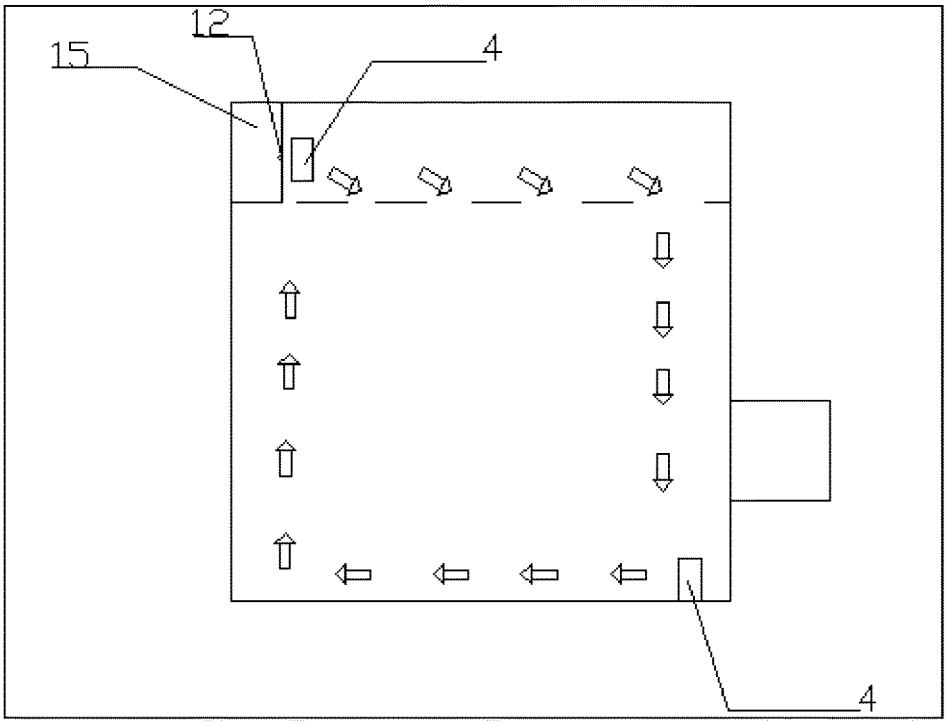
FIG. 4 is an air flow diagram of the present invention.

A strengthening and reinforcing device of the present invention has a structure as follows, shown as FIG. 1 to FIG. 4. The strengthening and reinforcing device, includes a double-open front door 1, a fan set 4, a dehumidifier 6, a vacuum pump 7, a light 10, a middle partition 11, a gas pipe hole 12, a rear panel 13, an ultrasonic atomizer 14, a gas pipe 15 and a pulley track 18; the double-open front door 1 is provided on one side face of the device; the middle partition 11 divides the device into an upper part and a lower part, bottom faces of the upper and lower parts are each provided with the fan set 4; the dehumidifier 6, the vacuum pump 7 and the ultrasonic atomizer 14 are arranged at an external surface of the rear panel 13 opposite the double-open front door 1; lights 10 are provided all around a lower part of the middle partition; the gas pipe 15 locates at and runs through an upper part of the middle partition 11, and that section of the gas pipe is provided with the gas pipe hole 12, the gas pipe 15 is connected with the ultrasonic atomizer 14; and the pulley track 18 is provided on the bottom face of the lower part of the device. The device further includes visible windows 2. Both sides of the double-open front door 1 and left and right sides of the device are provided with the visible windows 2. The device further includes a hygrometer 5, a piezometer 8 and a pH meter 9; the hygrometer 5, the piezometer 8 and the pH meter 9 are all provided in the interior of the device. A PLC-control system 16 is fixed on the double-open front door 1; the fan set 4, the dehumidifier 6, the vacuum pump 7, the ultrasonic atomizer 14, the lights 10 and a bookrack 19 are integrally controlled by the PLC-control system, by monitoring the hygrometer 5, the piezometer 8 and the pH meter 9, real-time control of on-off of the lights, on-off of the fan, wind speed, on-off of the dehumidifier, air volume of the dehumidifier, on-off of the vacuum pump, wind speed of vacuum pumping, on-off of the ultrasonic atomizer, atomization volume, on-off of spinning of the bookrack and duration of spinning of the bookrack is performed. The device is made of an external material and an internal material, the external material is carbon steel, and the internal material is stainless steel; the device has a total width of 1 m-2.5 m, a height of 1 m-2.5 m, and a length of 3 m-12 m. The device further includes a water groove 3 and a drain valve 17; the water groove is provided at the bottom face of the lower part of the device, locating at two sides of the device and the bottom face close to the rear panel; the water groove 3 has a depth of 1-10 cm below the bottom face and a width of 1-10 cm; the water groove 3 is connected to the drain valve 17; two pulley tracks 13 are provided, and a width between the two pulley tracks 13 is consistent with the width of the bookrack 19. The middle partition 11 is provided with an air outlet 20 thereon, since the closer to the fan, the higher the air velocity, an area of the air outlet increases with a distance from the fan set in a direction from the near to the distant. The bookrack 19 is made of stainless steel, with wheels at the bottom; the bookrack is provided with a link chain of stainless steel, a book basket is fixed on the link chain which is driven by a motor; after the motor is on, the book basket runs upward and downward so that more even absorption of atomized gas for the books is obtained; the book basket is designed as slightly wider at the top and slightly narrower at the bottom, the ancient books are opened laterally and placed with a lateral side facing upward, wind coming from the fan set 4 from top to bottom opens the ancient books slightly, allowing more even permeation of a strengthening and reinforcing agent.

Embodiment 1

Five *Ancient Medical Book* (edition 1937, published by People's Medical Publishing House) having a volume of 0.004 $m^3$ were taken and tested to have a paper original humidity of 8.6%, and the books were placed in a 0.25 m×0.25 m×0.1 m strengthening and reinforcing device having a volume of 0.00625 $m^3$. First, dehumidification was carried out to the system for 4 hours, and the dehumidifier was turned off when time's up. Then the vacuum pump was turned on to vacuumize the system until the pressure reached −0.05 MPa, and the vacuum pump was turned off. The ultrasonic atomizer was turned on, and a 0.1% CMC solution was selected as a strengthening and reinforcing agent and added to a container. The prepared CMC solution was atomized by the ultrasonic transducer and introduced into a sealed container via the gas pipe for strengthening and reinforcement. By adjusting an atomization volume of atomized gas, air humidity inside the system was controlled to be approximately 50%. The strengthening of ancient books was performed simultaneously with monitoring the humidity of the ancient books. When the monitored humidity of the ancient books reached 9%, the system was maintained stable for 2 hours, and then the system was turned off. Samples were taken to compare the paper performance average values before and after the strengthening and reinforcement, shown as Table 1:

TABLE 1

| | pH | Water content % | Tensile strength (kN/m) | Burst | Tear (mN) | Folding strength (Times) |
|---|---|---|---|---|---|---|
| Before the strengthening and reinforcement | 5.98 | 8.6 | 1.460 | 1.568 | 28 | 3 |
| After the strengthening and reinforcement | 6.21 | 9.1 | 3.540 | 2.425 | 34 | 4 |

Embodiment 2

Five *Ancient Medical Book* (edition 1937, published by People's Medical Publishing House) having a volume of 0.004 $m^3$ were taken and tested to have a paper original humidity of 7.1%, and the books were placed in a 0.25 m×0.25 m×0.1 m strengthening and reinforcing device having a volume of 0.00625 $m^3$. First, dehumidification was carried out to the system for 3 hours, and the dehumidifier was turned off when time's up. Then the vacuum pump was turned on to vacuumize the system until the pressure reached −0.01 MPa, and the vacuum pump was turned off. The ultrasonic atomizer was turned on, and a 0.1% CMC solution was selected as a strengthening and reinforcing agent and added to a container. The prepared CMC solution was atomized by the ultrasonic transducer and introduced into a sealed container via the gas pipe for strengthening and reinforcement. By adjusting an atomization volume of atomized gas, air humidity inside the system was controlled to be approximately 50%. The strengthening of ancient books was performed simultaneously with monitoring the humidity of the ancient books. When the monitored humidity of the ancient books reached 9%, the system was maintained stable for 2 hours, and then the system was turned off. Samples were taken to compare the paper performance average values before and after the strengthening and reinforcement, shown as Table 2:

TABLE 2

| | pH | Water content % | Tensile strength (kN/m) | Burst | Tear (mN) | Folding strength (Times) |
|---|---|---|---|---|---|---|
| Before the strengthening and reinforcement | 5.98 | 8.6 | 1.460 | 1.568 | 28 | 3 |
| After the strengthening and reinforcement | 6.22 | 9.0 | 3.430 | 2.315 | 33 | 3 |

Embodiment 3

Five *Ancient Medical Book* (edition 1937, published by People's Medical Publishing House) having a volume of 0.004 $m^3$ were taken and tested to have a paper original humidity of 7.1%, and the books were placed in a 0.25 m×0.25 m×0.1 m strengthening and reinforcing device having a volume of 0.00625 $m^3$. First, dehumidification was carried out to the system for 5 hours, and the dehumidifier was turned off when time's up. Then the vacuum pump was turned on to vacuumize the system until the pressure reached −0.05 MPa, and the vacuum pump was turned off. The ultrasonic atomizer was turned on, and a 0.2% CMC solution was selected as a strengthening and reinforcing agent and added to a container. The prepared CMC solution was atomized by the ultrasonic transducer and introduced into a sealed container via the gas pipe for strengthening and reinforcement. By adjusting an atomization volume of atomized gas, air humidity inside the system was controlled to be approximately 50%. The strengthening of ancient books was performed simultaneously with monitoring the humidity of the ancient books. When the monitored humidity of the ancient books reached 9%, the system was maintained stable for 2 hours, and then the system was turned off. Samples were taken to compare the paper performance average values before and after the strengthening and reinforcement, shown as Table 3:

TABLE 3

| | pH | Water content % | Tensile strength (kN/m) | Burst | Tear (mN) | Folding strength (Times) |
|---|---|---|---|---|---|---|
| Before the strengthening and reinforcement | 5.98 | 8.6 | 1.460 | 1.568 | 28 | 3 |
| After the strengthening and reinforcement | 6.11 | 9.3 | 3.980 | 2.935 | 35 | 4 |

The above embodiments of the present invention are merely illustrative examples for the present invention, but implementations of the present invention are not limited thereto. For those skilled in the art, various variation or alteration can be made based on the above description. However, there is no need and cannot be exhaustive for all implementations. Any modification, equivalent substitution and improvement made within the spirit and principle of the present invention shall be included in the scope of protection of the present invention.

What is claimed is:

1. A novel method for strengthening and reinforcing ancient books, wherein the method comprises:

first placing the ancient books to be treated in a closed strengthening and reinforcing device;

after sealing, performing dehumidification operation and vacuumizing operation on system in sequence to maintain the system dry;

after the system is stable under negative pressure, turning on a fan set, directly delivering a strengthening and reinforcing agent to the strengthening and reinforcing device via a gas pipe, or atomizing a solution of the strengthening and reinforcing agent through a ultrasonic atomizer and then delivering the atomized solution of the strengthening and reinforcing agent to the strengthening and reinforcing device via the gas pipe, so that the ancient books to be treated absorb the strengthening and reinforcing agent sufficiently and evenly; and meanwhile monitoring humidity of the ancient books, thereby implementing strengthening and reinforcement of the ancient books;

wherein the ancient books comprises ancient book, archived file, document, literature, journal, paper, calligraphy and painting, cotton and flax; and the closed strengthening and reinforcing device comprises a double-open front door, a fan set, a dehumidifier, a vacuum pump, a light, a middle partition, a gas pipe hole, a rear panel, an ultrasonic atomizer, a gas pipe and a pulley track; the double-open front door is provided on one side face of the device; the middle partition divides the device into an upper part and a lower part, bottom faces of the upper and lower parts are each provided with the fan set; the dehumidifier, the vacuum pump and the ultrasonic atomizer are arranged at an external surface of the rear panel opposite the double-open front door; lights are provided all around a lower part of the middle partition; the gas pipe locates at and runs through an upper part of the middle partition, and that section of the gas pipe is provided with the gas pipe hole, the gas pipe is connected with the ultrasonic atomizer; and the pulley track is provided on the bottom face of the lower part of the device; the device further includes visible windows, and each of the double-open front door and left and right sides of the device are provided with the visible window.

2. The novel method for strengthening and reinforcing ancient books according to claim 1, wherein a relationship of a device volume and a total volume of the ancient books to be treated satisfies that a ratio of the device volume to the total volume of the ancient books to be treated is 1.1:1-50:1.

3. The novel method for strengthening and reinforcing ancient books according to claim 1, wherein the dehumidification operation is as follows: dehumidifying the system to have air humidity of 10%-90% through a dehumidifier and maintaining for 2-24 hours; duration of the dehumidification operation depends on an original humidity of the ancient books and the closed device volume; when the original humidity of the ancient books is 8%-9% and the device volume is 1.5-2 times the total volume of the ancient books to be treated, the duration of the dehumidification operation is 2-24 hours; when the original humidity is reduced by 10%, the duration of the dehumidification operation is reduced by 2-6 hours; when the device volume is doubled, the duration of the dehumidification operation is increased by 3-8 hours.

4. The novel method for strengthening and reinforcing ancient books according to claim 1, wherein the vacuumizing operation is performed as follows: after the dehumidification operation is completed, vacuumizing the system to have an inner pressure of 0 to −0.08 MPa through a vacuum pump, and maintaining the closed system under stable negative pressure until the strengthening and reinforcement is completed.

5. The novel method for strengthening and reinforcing ancient books according to claim 1, wherein the ultrasonic atomizer is an ultrasonic transducer, the ultrasonic transducer is placed in a container containing with the strengthening and reinforcing agent and is powered on, wherein the structure of the strengthening and reinforcing agent is dispersed and atomized into small-molecular atomized gas by means of high-frequency resonance of a piezoelectric ceramic.

6. The novel method for strengthening and reinforcing ancient books according to claim 1, wherein the strengthening and reinforcing agent is a nanoscale strengthening and reinforcing powder, an organic solution, or an inorganic solution; the solution of the strengthening and reinforcing agent comprises an adhesive, a graft copolymer, a complex strengthening agent or a catalyst, and by means of a pressurizing or ultrasonic atomizer, the solution is dispersed into liquid drops in micronscale to nanoscale having an average particle size of 1 nm-2 μm.

7. The novel method for strengthening and reinforcing ancient books according to claim 1, wherein the strengthening and reinforcing agent comprises a nanoscale polyvinyl alcohol powder, a nanoscale carboxymethyl cellulose powder, and a nanocellulose powder.

8. The novel method for strengthening and reinforcing ancient books according to claim 1, wherein through the gas pipe, the fan set slowly introduces the nanoscale strengthening and reinforcing powder or the strengthening and reinforcing agent atomized by the ultrasonic transducer into the closed strengthening and reinforcing device, and circulates the strengthening and reinforcing agent inside the system for even distribution.

9. The novel method for strengthening and reinforcing ancient books according to claim 1, wherein air humidity inside the system is maintained at 10%-90%.

10. The novel method for strengthening and reinforcing ancient books according to claim 1, wherein the strengthening and reinforcing device has an ancient book humidity monitor therein, after the ancient book humidity monitored reaches 3%-10% and is maintained for 1-48 hours, the system is turned off; duration of the strengthening and reinforcement depends on the humidity of the ancient books and a closed device volume, when the original humidity of the ancient books is 5%-10% and the device volume is 1.5-2 times a total volume of the ancient books to be treated, the strengthening and reinforcement lasts for 2-5 hours; when the original humidity is increased by 1%, the duration of strengthening and reinforcement is reduced by 1-6 hours; when the device volume is doubled, the duration of strengthening and reinforcement is increased by 3-8 hours.

* * * * *